US007326019B2

(12) United States Patent
Loibl

(10) Patent No.: US 7,326,019 B2
(45) Date of Patent: Feb. 5, 2008

(54) METHOD FOR BINDING A SHEET STACK INTO A BINDER, BINDING APPARATUS FOR CARRYING OUT THAT METHOD, AND A BINDER SUITABLE THEREFOR

(75) Inventor: Bernd Loibl, Klettgau (DE)

(73) Assignee: Monolith GmbH Burosysteme, Essen (DE)

( * ) Notice: Subject to any disclaimer, the term of this patent is extended or adjusted under 35 U.S.C. 154(b) by 453 days.

(21) Appl. No.: 10/842,629

(22) Filed: May 11, 2004

(65) Prior Publication Data

US 2005/0008459 A1 Jan. 13, 2005

(30) Foreign Application Priority Data

May 12, 2003 (DE) ..... 103 21 419

(51) Int. Cl.
*B42C 13/00* (2006.01)
*B42C 9/00* (2006.01)
*B42B 9/00* (2006.01)

(52) U.S. Cl. ..... 412/22; 412/8; 412/41

(58) Field of Classification Search ..... 412/22, 412/70, 73, 75, 54, 68, 80, 72, 76, 33, 37, 412/4, 5, 9, 18, 10, 23, 41; 402/33, 37, 4, 402/5, 9, 18, 22, 10, 23, 41, 70, 73, 75, 54, 402/68, 80, 72, 76

See application file for complete search history.

(56) References Cited

U.S. PATENT DOCUMENTS 3,437,506 A 4/1969 Falberg
3,930,082 A * 12/1975 Waldeck ..... 442/38
RE28,758 E 4/1976 Decker
3,973,787 A 8/1976 Staats
4,009,498 A 3/1977 Staats
4,129,471 A 12/1978 Rome
4,141,100 A 2/1979 Domroe
4,244,069 A 1/1981 Hale
4,289,330 A * 9/1981 Wiermanski ..... 281/21.1
4,303,724 A * 12/1981 Sergeant et al. ..... 442/41
5,078,563 A * 1/1992 Lolli ..... 412/8
5,221,112 A * 6/1993 Holmberg ..... 281/21.1
5,314,283 A 5/1994 Zoltner (Continued)

FOREIGN PATENT DOCUMENTS

CH 333541 5/1954

(Continued)

*Primary Examiner*—Monica Carter
*Assistant Examiner*—Pradeep C Battula
(74) *Attorney, Agent, or Firm*—Berenato, White & Stavish

(57) ABSTRACT

A method for binding a sheet stack into a binder comprises a binder spine having an adhesive strip present on its inner side. The sheet stack is inserted into the binder in such a way that the stack's end face comes into contact with the adhesive strip. Thereafter the sheet stack is compressed by means of a pressing device, fanning out the end face of the sheet stack. And thereafter, in that state, an adhesive bond is created between the binder spine and sheet stack. Upon compression of the sheet stack, the pressing device exerts a linear pressure either directly onto the sheet stack or from outside onto the binder. The invention furthermore includes a binding apparatus to implement the method and a binder.

25 Claims, 4 Drawing Sheets

U.S. PATENT DOCUMENTS

| | | | | |
|---|---|---|---|---|
| 5,871,323 | A * | 2/1999 | Clark | 412/4 |
| 6,142,721 | A * | 11/2000 | Marsh | 412/1 |
| 6,692,208 | B1 * | 2/2004 | Watkiss et al. | 412/1 |
| 2005/0152771 | A1 * | 7/2005 | Huotari et al. | 412/8 |

FOREIGN PATENT DOCUMENTS

| | | | |
|---|---|---|---|
| CH | 333 541 | A | 12/1958 |
| CH | 364 242 | A | 10/1962 |
| CH | 364242 | | 10/1962 |
| DE | 955 226 | C | 1/1957 |
| DE | 14 11 004 | A1 | 10/1968 |
| DE | 22 56 259 | B2 | 8/1978 |
| DE | 25 28 225 | C2 | 5/1980 |
| DE | 38 05 996 | C2 | 6/1991 |
| EP | 295095 | A2 * | 12/1988 |
| EP | 0 140 197 | B1 | 4/1990 |
| EP | 0 581 394 | B1 | 5/1996 |
| FR | 673 507 | A | 1/1930 |
| GB | 2 186 526 | | 8/1987 |
| GB | 2186526 | | 8/1987 |
| WO | WO 01/62512 | A1 | 8/2001 |
| WO | WO 01/62512 | A2 | 8/2001 |

* cited by examiner

METHOD FOR BINDING A SHEET STACK INTO A BINDER, BINDING APPARATUS FOR CARRYING OUT THAT METHOD, AND A BINDER SUITABLE THEREFOR

CROSS-REFERENCE TO RELATED APPLICATIONS AND CLAIM TO PRIORITY

This application claims priority under 35 U.S.C. § 119 to application No. 103 21 419.4-26, filed May 12, 2003 in the Federal Republic of Germany, the disclosure of which is incorporated herein by reference.

FIELD OF THE INVENTION

The invention concerns a method for binding a sheet stack into a binder that comprises a binder spine having an adhesive strip present on its inner side, a sheet stack being inserted into the binder in such a way that the stack's end face comes into contact with the adhesive strip, after which the sheet stack is compressed by means of a pressing device, fanning out the end face of the sheet stack; and thereafter, in that state, an adhesive bond is created between the binder spine and sheet stack. The invention further refers to a binding apparatus for carrying out this method, the binding apparatus comprising a pressing device for compressing the sheet stack. Lastly, the invention comprises a binder that is particularly suitable for the method.

BACKGROUND OF THE INVENTION

It has been known for some time to produce company brochures, financial reports, marketing documents, or the like by binding the sheet stack that reproduces the contents into a binder that comprises a binder spine and binder covers continuous therewith. For that purpose, the binder spine has on the inner side an adhesive strip made of hot-melt adhesive. For binding, the combination of sheet stack and binder is put into a binding apparatus embodied as an office machine, and the binder spine is heated sufficiently that the hot-melt adhesive strip becomes plasticized and the ends of the sheet stack in contact therewith sink into the hot-melt adhesive strip. After removal of the combination, the hot-melt adhesive strip cools and thereby forms a permanent bond between the sheet stack and the binder.

Binders of this kind are known, for example, from U.S. Pat. No. 3,437,506, DE Pat. 25 28 225, U.S. Pat. No. 4,244,069, U.S. Pat. No. 4,289,330, and EP 0 410 197 B1. Binding apparatuses suitable for binding are evident from DE Examined Application 22 56 259, U.S. Pat. No. RE 28,758, U.S. Pat. No. 3,973,778, U.S. Pat. No. 4,129,471, U.S. Pat. No. 4,141,100, DE 38 05 996 C2, and EP 0 581 394 B1. All the binding apparatuses are configured in such a way that the combination of sheet stack and binder is inserted into an input slot that is open at the top, so that the outer side of the binder spine faces downward. The binder spine is placed on a heating plate that closes off the input slot at the bottom, and is heated by that plate. To ensure that the combination maintains its vertical position, the binding apparatus comprises a pressing device that compresses the combination and holds it in the upright position. The pressing device is, as a rule, embodied in such a way that at least one of the side walls delimiting the input slot is guided displaceably relative to the others, so that the width of the input slot can be modified and the combination can be held pressed between the two side walls.

In one method of the species (U.S. Pat. No. 4,141,100), a binder is used that comprises on the inner sides of the binder covers, in the vicinity of the binder spine, strips that are triangular in cross section and that extend parallel to the binder spine and are located opposite one another. Upon compression of the sheet stack by displacement of one of the two side walls of the input slot toward the other side wall, the sheet stack is intended thereby to be compressed in the region of the strips in order to hold the sheets of the sheet stack in their aligned position, and their lower edges in contact with the adhesive strip. Since compaction of the combination occurs above the strips, however, considerable doubt exists that the sheet stack is compressed—and the end face resting against the adhesive strip thus fanned out—in the manner depicted in FIG. 7 of U.S. Pat. No. 4,141,100. It may rather be assumed that the binder covers bulge outward in the region of the strips, and that the desired purpose is thus achieved not at all or at any rate incompletely.

In the method according to U.S. Pat. No. 3,973,787, binders are used in which the binder spine and also the adhesive strip are wider than the end face, resting thereagainst, of the sheet stack provided for the purpose. For binding, the combination of sheet stack and binder is inserted into the input slot of a binding apparatus in which the two side walls are movable toward one another for the purpose of contact against the outer sides of the binder covers. Arranged at each of the lower ends of the side walls near the heating plate is a respective roller that is resiliently suspended on the side walls. Upon compaction of the combination, these rollers first come into contact against the outer sides of the binder covers, thus ensuring that the externally located sides of the sheet stack have good contact with the adhesive strip. The binder cover is, in this context, pushed against the outer sides of the sheet stack. Only after that do the side walls of the input slot come to rest against the outer sides of the binder covers.

The known binding methods that are carried out using the binders and binding apparatuses recited in the documents have the disadvantage that the adhesive bond is not as strong as is necessary, at least when greater stresses are applied. Since these methods are used to produce brochures that are often representative in nature, it is essential that the brochures not fall apart even after repeated use.

SUMMARY OF THE INVENTION

It is thus the object of the invention to embody a method for binding a sheet stack into a binder in such a way that a substantially stronger bond is achieved between the binder and sheet stack. A second part of the object is to make available an apparatus suitable for this purpose. A suitable binder is the subject matter of the third part of the object.

The first part of the object is achieved, according to the present invention, in that upon compression of the sheet stack, the pressing device exerts a linear pressure either directly onto the sheet stack or from outside onto the binder, and a fanning-out of the end face of the sheet stack is thereby achieved. In contrast to the method of the species (U.S. Pat. No. 4,141,100), therefore, a fanning-out of the sheet stack is achieved here by means of a linear pressure exerted by the pressing device either directly onto the sheet stack or onto the combination of sheet stack and binder. By appropriate exertion of linear pressure, fanning-out can be effected in such a way that an adhesive strip plasticized by heat penetrates into the interstices between the individual sheets, and a hitherto unattainable strength is thereby achieved, after cooling, in the bond between the binder spine and sheet stack. The fanning-out can be configured, by appropriate adjustment of the linear pressure, in such a way that the width of the end face of the sheet stack becomes greater than the thickness of the sheet stack in the uncompacted region, i.e. in the region that, viewed from the binder spine, is located remotely from the exertion of linear pressure. This results in particularly wide spacings between the ends of the sheet stack, and thus in a good opportunity for the adhesive to penetrate between the individual sheets.

A particularly good spreading effect is achieved if the sheet stack has linear pressure applied to it at a distance of 0.5 to 2 cm from its end face. The linear pressure application can be accomplished, for example, by way of protruding pressing bars belonging to the pressing device.

A particularly strong bond can be achieved using the method according to the present invention by the fact that the binder spine and the end face of the sheet stack are pushed against one another with an additionally applied compressive force as the adhesive bond is produced. This improves penetration of the plasticized hot-melt adhesive between the sheets of the sheet stack. With this method, it is also possible to use binders in which the binder spine is equipped with an adhesive strip made of a pressure-sensitive contact adhesive. The heating device, and the energy expenditures associated therewith, could thus be omitted from the binding apparatuses.

The compressive force is preferably applied from outside onto the binder spine. This can be done in planar fashion, for example with the use of a compression plate. The compressive force can also, however, be applied progressively in linear fashion, for example using a pressure roller displaceable along the binder spine.

It is useful for the method to be performed in a position in which the sheet stack is not pushed by its own weight against the binder spine. Compression of the sheet stack should accordingly be accomplished with the latter in a horizontal or vertical position with a laterally extending binder spine, in a vertical position with the binder spine at the top, or in a position between these positions. This promotes fanning-out of the end face of the sheet stack adjacent to the adhesive strip, and thus penetration of the adhesive between the sheets.

According to a further feature of the invention, provision is made to use an adhesive strip whose width corresponds to at least 1.2 times the thickness of the sheet stack in the uncompacted state, so that even the outer sheets of the sheet stack, after the latter is fanned out, are captured by the adhesive. The same applies to the width of the binder spine.

The second part of the object is achieved, according to the present invention, in that the pressing device is embodied in such a way that it exerts a linear pressure, either directly onto the sheet stack or from outside onto the binder, upon compression of the sheet stack. This can occur, for example, by the fact that the pressing device comprises pressing bars, movable toward one another and relative to one another, that are mounted on holding elements in such a way that they occupy a protruding position with respect to the holding elements even during compaction of the sheet stack. Both an embodiment in which one holding element is mounted on the apparatus and the other holding element is guided movably relative to the first, and an embodiment in which the two holding elements are guided movably relative to one another, are suitable. The pressing bars can certainly be mounted resiliently on the holding elements, provided there is assurance that upon compaction, their protruding position is maintained and a linear pressure is thus exerted on the sheet stack. It is advisable, however, for the pressing bars to be attached rigidly to the holding elements.

The pressing bars are advantageously arranged in such a way that they extend in the region of the half of the sheet stack adjacent to the binder spine, preferably at a distance of 0.5 to 2 cm from the binder spine, when the combination of binder and sheet stack is introduced as intended. Particularly good fanning is achieved in this fashion.

According to a further feature of the invention, provision is made for the binding apparatus to comprise a pressure device for pressing the binder spine against the sheet stack upon compaction of the latter. As already mentioned above, penetration of the adhesive between the sheets of the sheet stack is thereby made more intensive, and the possibility is also created of using a pressure-sensitive contact adhesive instead of a hot-melt adhesive. The pressure device can comprise a pressing ram, which can be applied against the outer side of the binder spine and can be embodied as a pressure roller that can roll over the binder spine or as a pressing plate that can be pressed in planar fashion onto the binder spine. If the adhesive strip is made of hot-melt adhesive, the binding apparatus must have a heating device for plasticizing the adhesive strip, for example in the form of a heating plate. This can be placed in planar fashion against the binder spine and guided movably away from it again when the combination of binder and sheet stack is put into the binding apparatus in the manner intended.

According to a further feature of the invention, provision is made for the binding apparatus to have an input slot, and for the pressing bars to be arranged in the region of the first half of the input slot when viewed from the latter's input opening. With a binding apparatus of this kind, the combination of binder and sheet stack is therefore introduced into the input slot in such a way that the binder spine ends up adjacent to the input opening. The input opening can be open toward the side, obliquely upward, or at the top.

If a pressure device and/or a heating device is/are provided, it/they should be arranged respectively on one of the holding elements in the region of the input opening.

The third part of the object, referring to the binder, is achieved according to the present invention in that the adhesive strip of the binder comprises a reinforcement insert, preferably in the form of a textile strip such as a gauze strip. This embodiment, too, contributes to better durability of the bond between adhesive strip and sheet stack.

DESCRIPTION OF THE DRAWINGS

The invention is depicted in several steps, with reference to an exemplary embodiment, in the drawings, in which.

DETAILED DESCRIPTION OF THE PREFERRED EMBODIMENT(S)

Figure 1:
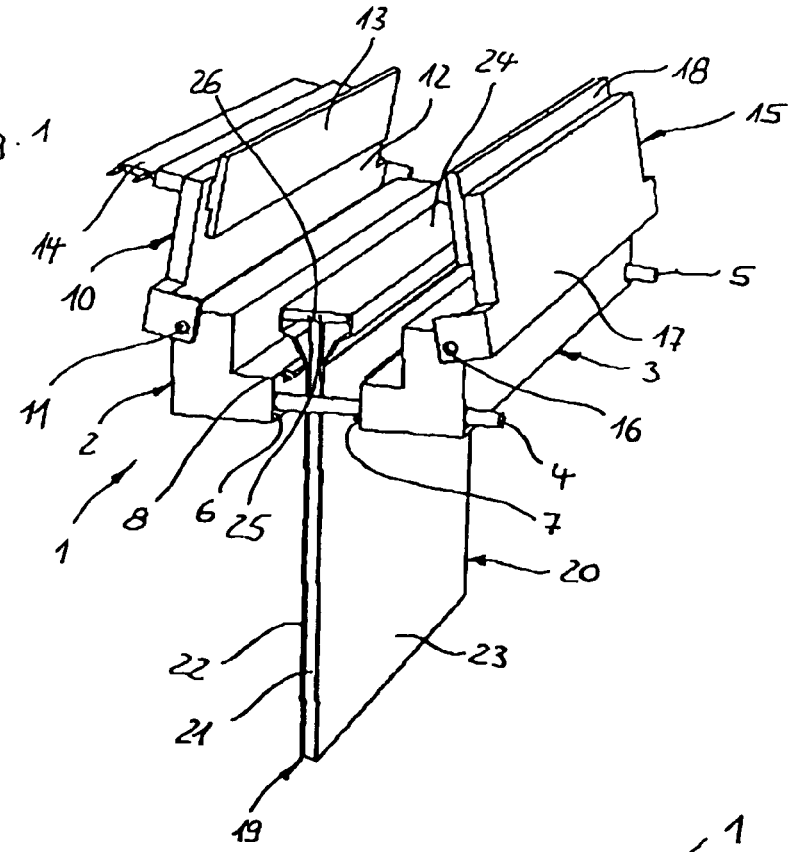
FIG. 1 is a perspective view of the binding apparatus according to the present invention with an inserted combination of binder and sheet stack, before the binding operation.

Binding apparatus 1 depicted in the FIGS. comprises two holding elements 2, 3 that are L-shaped in cross section and are arranged parallel to one another and at the same height. Left-side holding element 2 comprises, extending horizontally transversely to its longitudinal extension, two guide rods 4, 5 that penetrate through right-side holding element 3, so that the latter holding element 3 is guided displaceably on guide rods 4, 5 relative to left-side holding element 2 and transversely to the latter's longitudinal extension. The unobstructed spacing between holding elements 2, 3 can be modified in this fashion.

The two holding elements 2, 3 and guide rods 4, 5 delimit the upper end of an input slot (not depicted here in detail) that is adjacent to holding elements 2, 3 toward the bottom. Further parts of binding apparatus 1, in particular the apparatus frame with control devices, etc. have been omitted here for reasons of clarity.

Mounted on the mutually facing longitudinal sides 6, 7 of holding elements 2, 3 are pressing bars 8, 9 that have an approximately triangular cross section and extend along holding elements 2, 3. They are located opposite one another at the same height. As the spacing between holding elements 2, 3 changes, their spacing also changes.

A heating element 10 is mounted on left-side holding element 2, pivotably about a shaft 11 that extends parallel to the longitudinal axis of holding element 2. Heating element 10 has a carrier plate 12 at whose free end a heating plate 13 is attached displaceably perpendicular to the plane of carrier plate 12. Heating plate 13 has a connector strip 14 for connection to an electrical power source. Heating plate 13 extends over almost the entire length of holding element 2 between the two guide rods 4, 5. Heating plate 13 can be heated to a temperature at which a hot-melt adhesive usually used for binders can be plasticized.

A pressure element 15 is mounted on right-side holding element 3 pivotably about a shaft 16, shaft 16 extending parallel to shaft 11 and thus parallel to the longitudinal axes of holding elements 2, 3. Pressure element 15 has a carrier plate 17 on whose free end a pressing plate 18 is mounted.

A combination 19 of binder 20 and sheet stack 21 is inserted in a vertical position into the input slot of binding apparatus 1, i.e. between holding elements 2, 3 and guide rods 4, 5. Combination 19 can be set with its lower side, for example, on a support plate. Binder 20 has two binder covers 22, 23 that cover sheet stack 21 in planar fashion. Binder covers 22, 23 are joined at the top by a binder spine 24 that is integral with binder covers 22, 23 and joined to them via creases.

Binder spine 24 is considerably wider than the thickness of sheet stack 21, the relationships being shown in exaggerated fashion here for better depiction of this embodiment. An adhesive strip 25 made of a hot-melt adhesive or pressure sensitive contact adhesive is applied on the inner side of binder spine 24. It is permanently adhered to binder spine 24 and is reinforced with a gauze strip that is embedded in adhesive strip 25. Sheet stack 21 rests with its top end face 26 against the exposed side of adhesive strip 25, or is at only a short distance therefrom.

Figure 2:
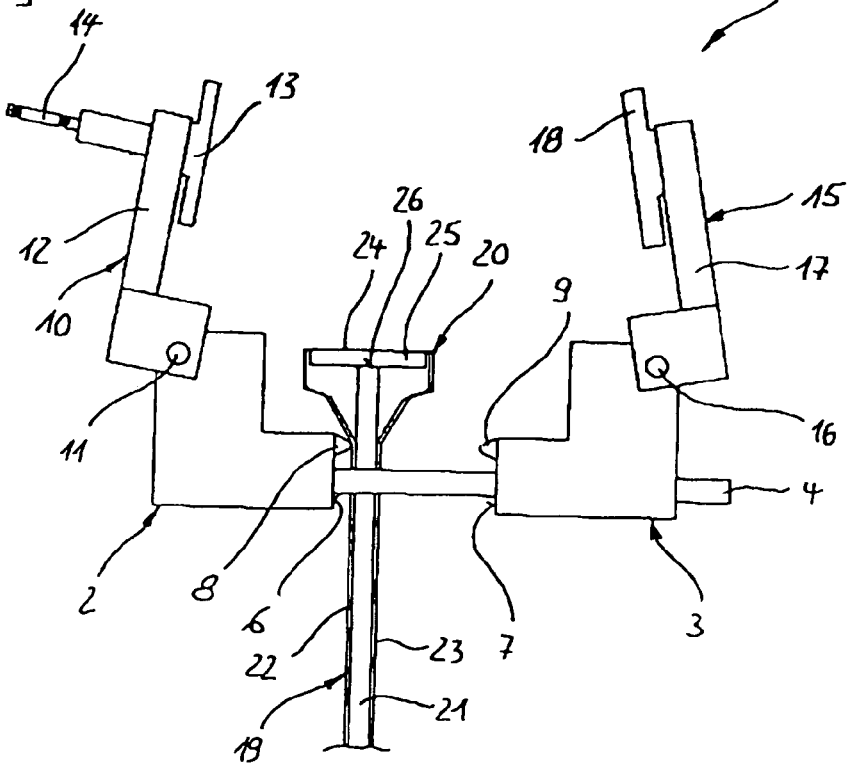
FIG. 2 is a frontal view of the binding apparatus in the position shown in FIG. 1.

The binding operation using binding apparatus 1 and combination 19 of binder 20 and sheet stack 21, as depicted in the Figures, is configured as follows. Firstly, as depicted in FIGS. 1 and 2, combination 19 is put into binding apparatus 1 from above so that it assumes the position shown in those FIGS. Binder 20 is pre-shaped in the region of binder spine 24 in such a way that the spacing of binder covers 22, 23 from adhesive strip 25 initially remains the same but then tapers, first more sharply and then less so, until binder covers 22, 23 come into contact with sheet stack 21 at the level of pressing bars 8, 9. In the position shown in FIGS. 1 and 2, combination 19 rests with binder cover 22 against left-side pressing bar 8, while right-side pressing bar is still at a considerable distance from said combination 19. Both heating element 10 and pressure element 15 are pivoted up so that carrier plates 12, 17 are almost vertical.

Figure 3:
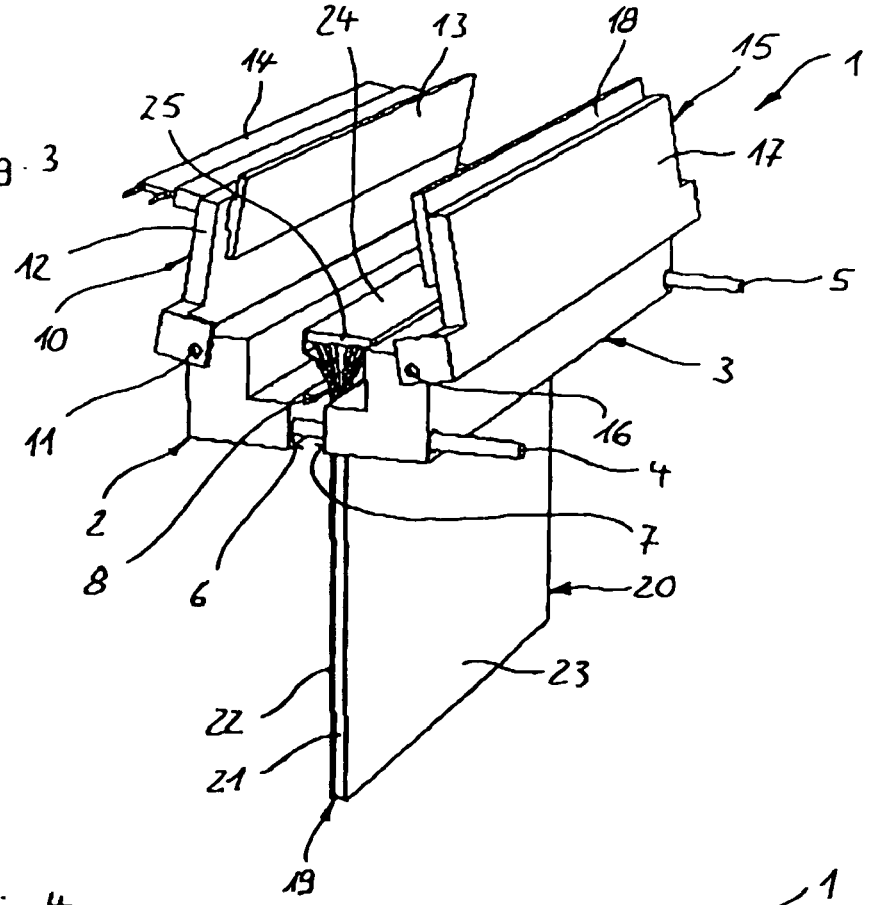
FIG. 3 is a perspective view of the binding apparatus according to FIGS. 1 and 2, the combination of binder and sheet stack having been compressed.
Figure 4:
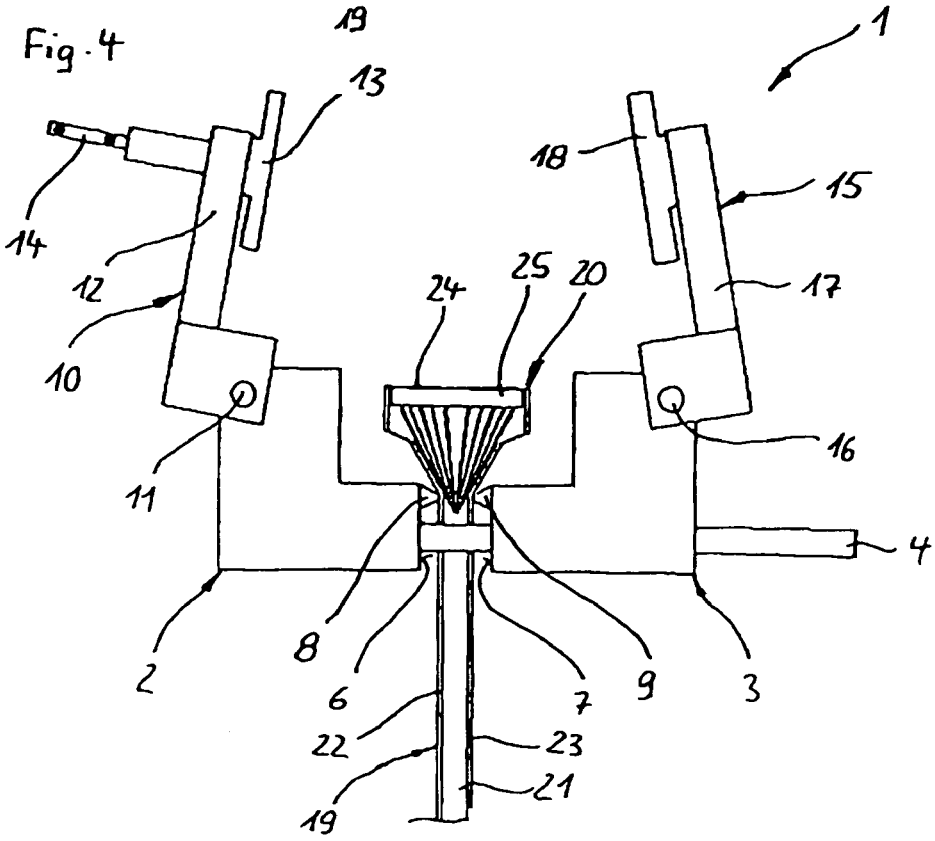
FIG. 4 is a frontal view of the binding apparatus in the position shown in FIG. 3.

As is evident from FIGS. 3 and 4, after combination 19 has been put into binding apparatus 1, firstly a compaction of combination 19 between pressing bars 8, 9 occurs. For that purpose, right-side holding element 3 is displaced on guide rods 4, 5 in the direction of left-side holding element 2 with a drive device (not depicted here in detail), for example a spindle drive, so that right-side pressing bar 9 also comes into contact against binder 20. Further compaction causes a linear pressure to be exerted on both sides, via pressing bars 8, 9, on binder covers 22, 23 and thus also on sheet stack 21. This causes a fanning-out of the region of sheet stack 21 above pressing bars 8, 9, which is further promoted by the fact that the spacing of binder covers 22, 23 widens toward binder spine 24. The fanning-out is, however, limited in such a way that the ends of the two outer sheets of sheet stack 21 are still located below adhesive strip 25. The result of the fanning-out is in turn that the sheets of sheet stack 21 are spaced apart from one another in the region of end face 26.

Figure 5:
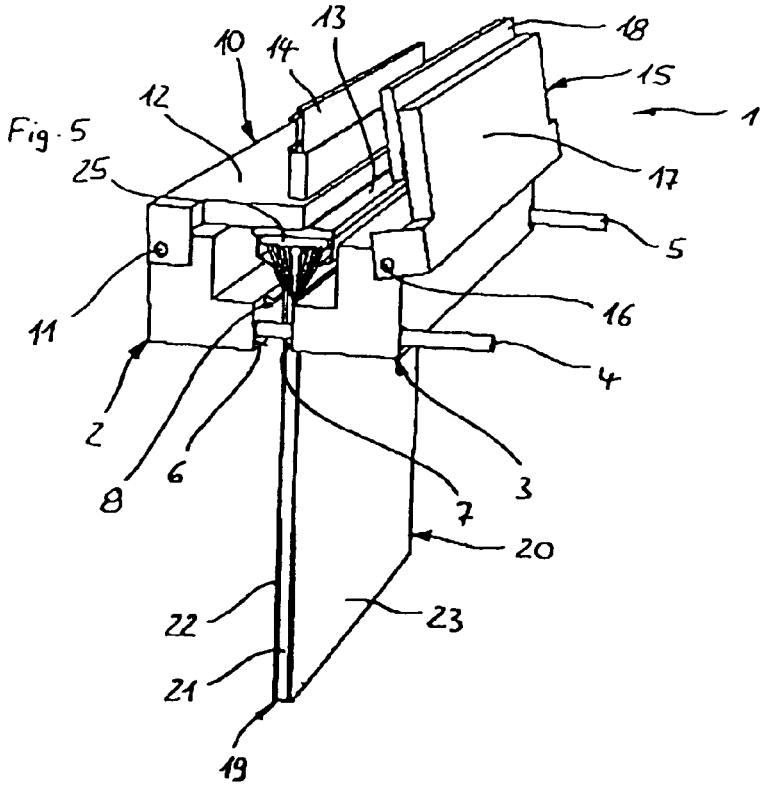
FIG. 5 is a perspective view of the binding apparatus according to FIGS. 1 through 4, in the position with the heating plate placed onto the binder spine.
Figure 6:
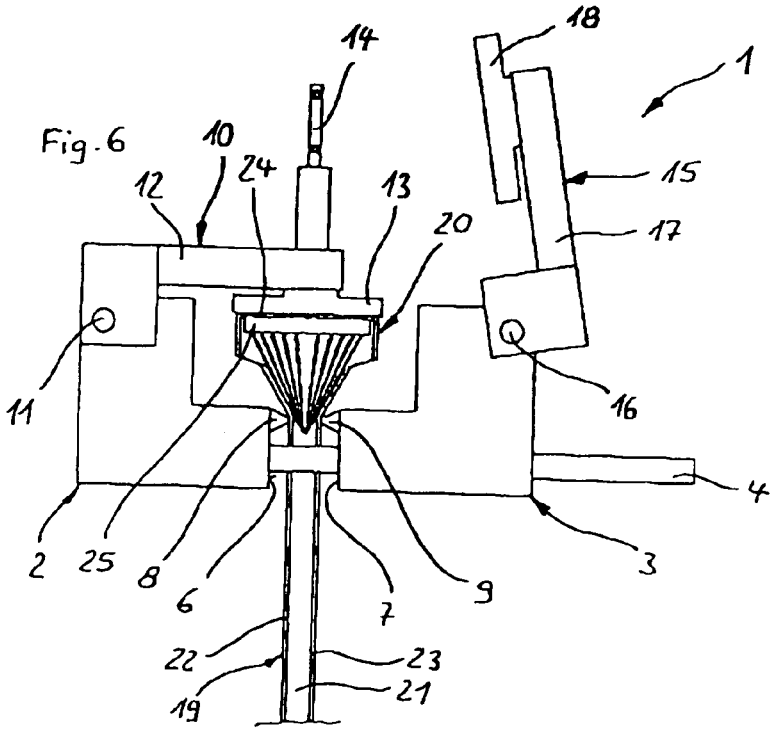
FIG. 6 is a frontal view of the binding apparatus in the position shown in FIG. 5.

FIGS. 5 and 6 depict the step of plasticizing adhesive strip 25. As compared with the position shown in FIGS. 3 and 4, for this purpose heating element 10 is pivoted so that heating plate 13 comes into planar contact with the outer side of binder spine 24. As a result, sufficient heat is transferred to adhesive strip 25 that it reaches the plasticizing temperature and, as a result thereof and because of the pressure of heating plate 13, penetrates into the interstices between the sheets of sheet stack 21. The linear pressure exerted via pressing bars 8, 9 is maintained in this context.

Figure 7:
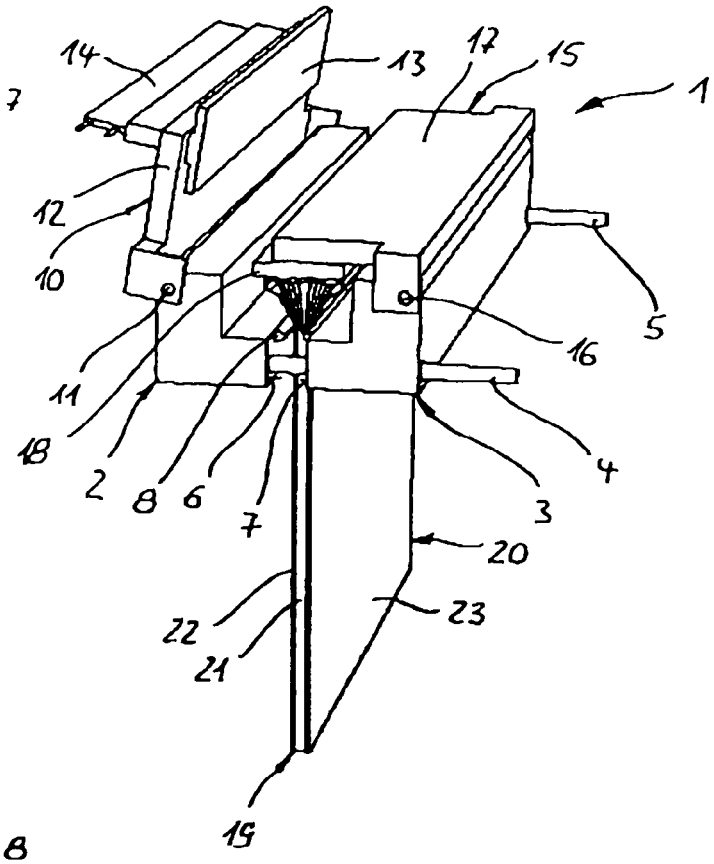
FIG. 7 is a perspective view of the binding apparatus according to FIGS. 1 through 6 with the compression plate in contact against the binder spine.
Figure 8:
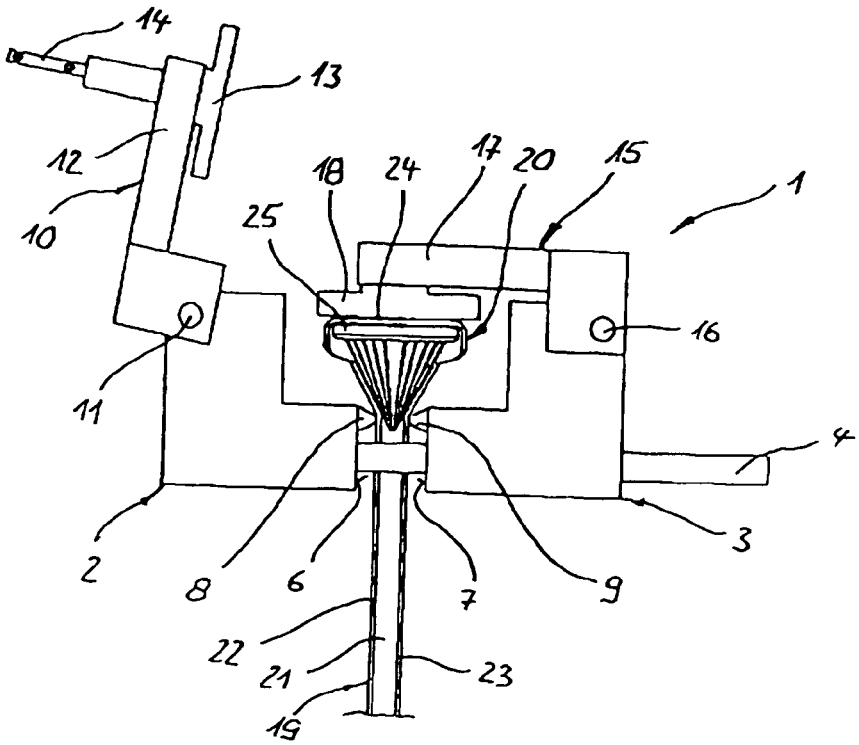
FIG. 8 is a frontal view of the binding apparatus in the position shown in FIG. 7.

In the last step, depicted in FIGS. 7 and 8, heating element 10 is pivoted back up into its initial position, and pressure element 15 is instead pivoted downward toward binder spine 24 and brought into contact against its outer side. By way of pressure plate 18, pressure is exerted vertically downward so that the spacing between binder spine 24 and pressing bars 8, 9 decreases. This results in additional penetration of adhesive strip 25 into the interstices between the sheets of sheet stack 21. The pivoting of heating element 10 and pressure element 15 can be effected manually by way of corresponding levers, but also with electric motors.

Pressure element 15 is then also pivoted back up into its initial position, and right-side holding element 3 is moved back into the outer position depicted in FIGS. 1 and 2. Combination 19 of binder 20 and sheet stack 21 can be removed and placed in a rack for cooling. After cooling, and thus after adhesive strip 25 has hardened, an extraordinarily strong bond is created between sheet stack 21 and binder 20.

I claim:

1. A method for binding a sheet stack (21) into a binder (20) that comprises a binder spine (24) having an adhesive strip (25) present on its inner side, the sheet stack (21) being inserted into the binder (20) in such a way that the stack's end face comes into contact with the adhesive strip (25), after which the sheet stack (21) is compressed by means of a pressing device (2, 3, 8, 9), fanning out the end face (26) of the sheet stack (21); and thereafter, in that state, an adhesive bond is created between the binder spine (24) and the sheet stack (21), wherein upon compression of the sheet stack (21), the pressing device (2, 3, 8, 9) exerts a linear pressure either directly onto the sheet stack (21) or from outside onto the binder (20).

2. The method as defined in claim 1, wherein the sheet stack (21) is fanned out by the compression in such a way that the width of the end face (26) of the sheet stack (21) becomes greater than the thickness of the sheet stack (21) in the uncompacted region.

3. The method as defined in claim 1, wherein the sheet stack (21) has linear pressure applied to it at a distance of 0.5 to 2 cm from its end face (26).

4. The method as defined in claim 1, wherein the sheet stack (21) has linear pressure applied to it by way of protruding pressing bars (8, 9) belonging to the pressing device.

5. The method as defined in claim 1, wherein the binder spine (24) and the end face (26) of the sheet stack (21) are pushed against one another with an additionally applied compressive force as the adhesive bond is produced.

6. The method as defined in claim 5, wherein the compressive force is applied from outside on the binder spine (24).

7. The method as defined in claim 5, wherein the compressive force is applied in planar fashion.

8. The method as defined in claim 5, wherein the compressive force is applied progressively in linear fashion.

9. The method as defined in claim 1, wherein the compression of the sheet stack (21) is accomplished with the latter in a horizontal or vertical position with a laterally extending binder spine (24), in a vertical position with the binder spine (24) at the top, or in a position between these positions.

10. The method as defined in claim 1, wherein the adhesive strip is made of hot-melt adhesive, and the adhesive strip is heated to a plasticizing temperature when the sheet stack is compressed.

11. The method as defined in claim 1, wherein the adhesive strip is made of pressure-sensitive contact adhesive and the adhesive strip is pressed against the sheet stack when the sheet stack is compressed.

12. The method as defined in claim 1, wherein the adhesive strip has a width corresponding to at least 1.2 times the thickness of the sheet stack in the uncompacted state.

13. A binding apparatus for binding a sheet stack into a binder having a binder spine and an adhesive strip present on the inner side of the binder spine, the binding apparatus comprising:

a pressing device for compressing the sheet stack and fanning out an end face of the sheet stack, wherein the pressing device includes first and second holding elements and exerts a linear pressure, either directly onto the sheet stack or from outside onto the binder, upon compression of the sheet stack, and a pressure device mounted movably on one of the first and second holding elements in the region of an input opening for pressing the binder spine against the sheet stack upon compaction of the latter, wherein the pressure device comprises a pressing ram that can be placed against the outer side of the binder spine.

14. The binding apparatus as defined in claim 13, wherein the pressing device further comprises two pressing bars, movable toward one another and relative to one another, that are mounted on holding elements in such a way that they occupy a protruding position with respect to the holding elements even during compaction of the sheet stack.

15. The binding apparatus as defined in claim 14, wherein the pressing bars are arranged in such a way that they extend in the region of the half of the sheet stack (21) adjacent to the binder spine (24) when the combination (19) of binder (20) and sheet stack (21) is introduced as intended.

16. The binding apparatus as defined in claim 14, wherein the binding apparatus further comprises an input slot, and the pressing bars are arranged in the region of the first half of the input slot when viewed from the latterts input opening.

17. The binding apparatus as defined in claim 16, wherein the input opening is open toward the side, obliquely upward, or at the top.

18. The binding apparatus as defined in claim 13, wherein the pressing ram is embodied as a pressure roller that can roll over the binder spine.

19. The binding apparatus as defined in claim 13, wherein the pressing ram is embodied as a pressing plate that can be pressed in planar fashion onto the binder spine.

20. The binding apparatus as defined in claim 13, wherein the binding apparatus further comprises a heating device for plasticizing the adhesive strip.

21. A binding apparatus for binding a sheet stack into a binder having a binder spine and an adhesive strip present on the inner side of the binder spine, the binding apparatus comprising:

a pressing device for compressing the sheet stack and fanning out an end face of the sheet stack, wherein the pressing device includes first and second holding elements and two pressing bars, movable toward one another and relative to one another, that are mounted on the holding elements in such a way that they occupy a protruding position with respect to the holding elements even during compaction of the sheet stack, and exert a linear pressure, either directly onto the sheet stack or from outside onto the binder, upon compression of the sheet stack, and a pressure device mounted movably on one of the first and second holding elements in the region of an input opening for pressing the binder spine against the sheet stack upon compaction of the latter, wherein the pressing bars are attached rigidly to the holding elements.

22. A binding apparatus for binding a sheet stack into a binder having a binder spine and an adhesive strip present on the inner side of the binder spine, the binding apparatus comprising:

a pressing device for compressing the sheet stack and fanning out an end face of the sheet stack, wherein the pressing device includes first and second holding elements and two pressing bars movable toward one another and relative to one another mounted on the holding elements in such a way that they occupy a protruding position with respect to the holding elements even during compaction of the sheet stack, the pressing device exerting a linear pressure, either directly onto the sheet stack or from outside onto the binder, upon compression of the sheet stack, and a pressure device mounted movably on one of the first and second holding elements in the region of an input opening for pressing the binder spine against the sheet stack upon compaction of the latter, wherein the pressing bars are arranged in such a way that they extend in the region of the half of the sheet stack adjacent to the binder spine and extend at a distance of 0.5 to 2 cm from the binder spine when the combination of binder and sheet stack is introduced as intended into the binding apparatus.

23. A binding apparatus for binding a sheet stack into a binder having a binder spine and an adhesive strip present on the inner side of the binder spine, the binding apparatus comprising:

a pressing device for compressing the sheet stack and fanning out an end face of the sheet stack, wherein the pressing device includes first and second holding elements and exerts a linear pressure, either directly onto the sheet stack or from outside onto the binder, upon compression of the sheet stack;

a pressure device mounted movably on one of the first and second holding elements in the region of an input opening for pressing the binder spine against the sheet stack upon compaction of the latter; and a heating device for plasticizing the adhesive strip comprising a heating plate.

24. The binding apparatus as defined in claim 23, wherein the heating plate (13) can be placed in planar fashion against the binder spine (24) and moved away from it again when the combination (19) of binder (20) and sheet stack (21) is put into the binding apparatus (1) as intended.

25. A binding apparatus for binding a sheet stack into a binder having a binder spine and an adhesive strip present on the inner side of the binder spine, the binding apparatus comprising:

a pressing device for compressing the sheet stack and fanning out an end face of the sheet stack, wherein the pressing device includes first and second holding elements and exerts a linear pressure, either directly onto the sheet stack or from outside onto the binder, upon compression of the sheet stack, and a heating device for plasticizing the adhesive strip, wherein the heating device is arranged on one of the holding elements in the region of an input opening.

* * * * *